United States Patent [19]

Guery et al.

[11] 4,330,693

[45] May 18, 1982

[54] MULTI-POLAR SWITCH

[75] Inventors: Jean-Pierre Guéry, Poissy; Bernard Roblin, La Celle Saint Cloud, both of France

[73] Assignee: La Telemecanique Electrique, France

[21] Appl. No.: 4,774

[22] Filed: Jan. 19, 1979

[30] Foreign Application Priority Data

Jan. 19, 1978 [FR] France ..... 78 02106

[51] Int. Cl.[3] ..... H01H 15/00

[52] U.S. Cl. ..... 200/1 R; 200/153 LA; 200/6 BB; 200/5 R

[58] Field of Search ..... 200/1 R, 5 R, 5 E, 5 EA, 200/5 EB, 16 R, 16 A, 16 B, 16 C, 17, 153 L, 153 LA, 159 R, 159 A, 243, 6 BB, 38 E

[56] References Cited

U.S. PATENT DOCUMENTS

| | | | |
|---|---|---|---|
| 3,047,682 | 7/1962 | Hults | 200/153 LA |
| 3,676,625 | 7/1972 | Blatt | 200/153 LA |
| 3,849,610 | 11/1974 | Lockard et al. | 200/6 BB |

*Primary Examiner*—J. D. Miller
*Assistant Examiner*—D. L. Rebsch
*Attorney, Agent, or Firm*—William A. Drucker

[57] ABSTRACT

A multipolar switch has elements which can be readily assembled and combined for obtaining closing conracts or opening contacts. The body of the apparatus comprises a mounting base and an upper portion, the mounting base receiving an operating member which is movable in translation, the upper portion receiving a cover to close laterally some housings for terminals, some passageways for the retention of contacts, and some breaking chambers.

5 Claims, 9 Drawing Figures

Fig. 2
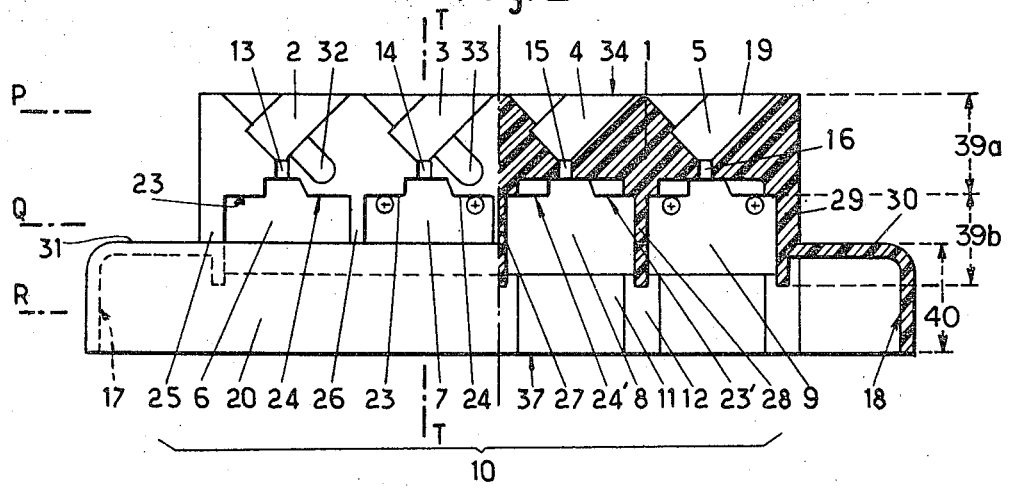
Fig. 1
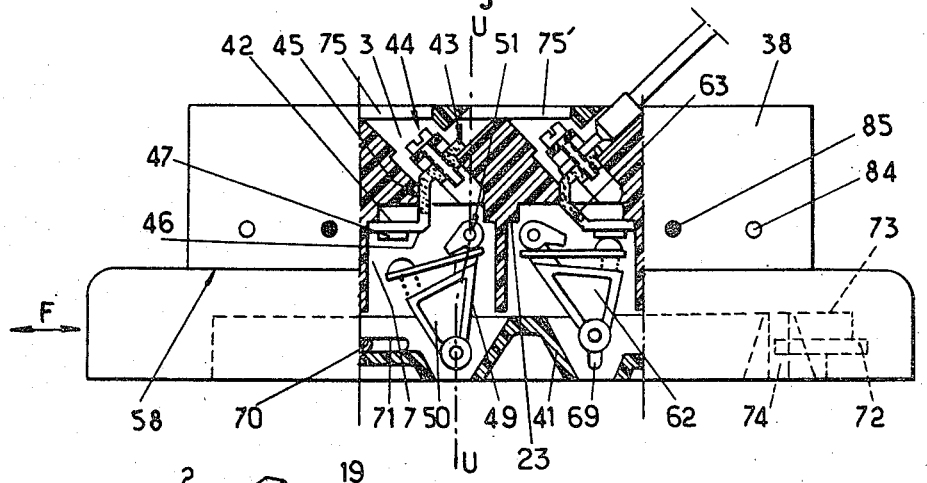
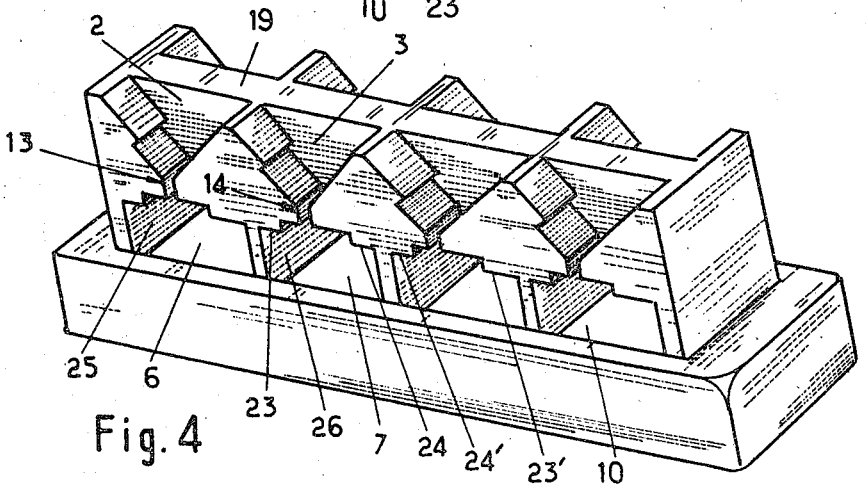
Fig. 4

MULTI-POLAR SWITCH

BACKGROUND OF THE INVENTION

The invention relates to a multipolar switch comprising for each circuit at least one fixed contact and a movable contact provided with connecting means and contact elements, the contact elements and the movable contact being situated in a switching chamber isolated from the neighboring chambers by walls, whereas the connecting means are disposed in separate housings, a single operating member movable in translation in a guiding chamber being coupled to a plurality of movable contact carriers.

Such switches find use either as switches for manual control, or as auxiliary switches intended to be coupled in removable manner with a remotely controlled switching apparatus.

THE PRIOR ART

In the apparatuses of the prior art, there is often found a construction in which the contacts, both fixed and moving are disposed in a casing of which two opposed faces receive the connecting means. This simple construction nevertheless requires a cumbersome placing of the connected conductors.

In other known apparatus, the connecting terminals are disposed on the same face of a single casing, but no separation of the functions is obtained, the quality of the insulation is not good and the mounting is not simple.

OBJECTS OF THE INVENTION

A first object of the invention is accordingly to provide an improved multipolar switch assembly incorporating the advantages of the known apparatuses, but in which supplementary features permit, as well as the easier mechanisation of its assembly, the obtaining of a precision which is compatible with the avoidable allowances to which the various component parts of the apparatus must be subject.

A second object is to provide a multipolar switch assembly wherein the function of break contact or make contact can be readily modified through the use of a reduced number of component parts.

SUMMARY OF THE INVENTION

According to the invention this result is obtained in that:

(a) (i) the upper recesses for the connecting means
(ii) the channels for bridging contacts and
(iii) the guiding lower recess are disposed, in that order, in three planes disposed parallel to the direction of displacement of the operating member and are formed by cavities provided in a common body, (b) the upper recesses and the channels concerned in a same circuit communicate together through a passageway and are all three accessible in a direction which is substantially perpendicular to the direction of displacement and which is situated in a further plane parallel to the above mentioned three planes, (c) the fixed contact of a circuit is put in place along this latter direction of access and passes through the said passageway, and (d) and a cover having a top portion provided with openings and at least one lateral wall perpendicular to said top portion is fixed on the body in such a manner that the said top portion presents openings opposite to the terminals placed in the said housings, and the said lateral wall totally closes the accessible parts of the upper recesses of the transverse channels and of the passageways.

BRIEF DESCRIPTION OF THE DRAWINGS

These and other objects, together with the advantages of the invention, will be better understood with the aid of the following description with reference to the accompanying drawings, wherein:

FIG. 1 is an elevation of the complete switch, parts of the cover and of the body being broken away;

FIG. 2 is an elevation of the body of the switch, the other elements thereof being removed;

FIG. 4 is a perspective view of the upper portion of the body of the apparatus;

DESCRIPTION OF THE PREFERRED EMBODIMENT

Figure 3:
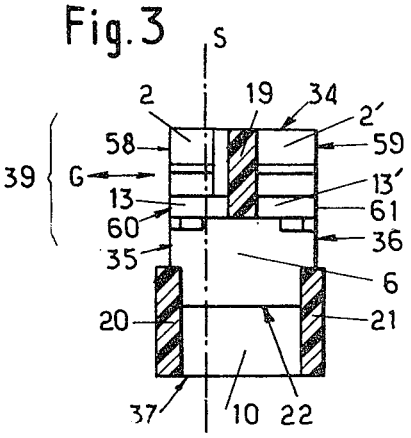
FIG. 3 is a transverse section taken along the line T of FIG. 2.

The body 1, of the switch comprising a base portion 40 and two upper portions 39*a*–39*b*, visible in FIG. 2, has in the first upper portion 39*a* a series of identical upper recesses 2, 3, 4, 5, a series of identical transverse channels 6, 7, 8, 9, isolated by parallel walls 25, 26, 27, 28, 29 and a lower recess 10 disposed in said base portion.

These upper recesses, transverse channels and lower recess are disposed in that order in respective parallel planes P, Q and R which are themselves parallel to a reference surface, for example the surface 37 of the base portion of the body along which it is secured.

As can be seen in this figure, the pairs of upper recesses and the transverse channels are four in number and are associated respectively with the control of circuits of which two are visible in FIG. 1. In the embodiment illustrated, the apparatus thus controls four circuits. The lower recess 10 is in direct communication with the transverse channels 6, 7, 8, 9, see FIG. 3, and extends between the end surfaces 17, 18 and the lateral walls 20, 21 of the base portion 40 of the body along a length which is greater than the sum of the lengths of the transverse recesses, see FIG. 2.

Furthermore, each upper recess is joined to a neighboring transverse channel by a passageway of small width; thus, the passageways 13, 14, 15, 16 join the transverse channel and upper recesses respectively 6 and 2, 7 and 3, 8 and 4 and 9 and 5.

Each upper recess and each transverse channel opens laterally, that is to say perpendicularly to the plane of the drawing towards the reader, see the direction G in FIG. 3; furthermore, each upper recess opens on the surface 34 of the first upper portion 39*a* of the body and comprises a cavity 32, 33 for the reception of the screw 44, each upper recess being, as already indicated, in communication by its lower region with the lower recess 10.

As a non limiting example, the apparatus comprises, as can be seen in FIG. 3, two upper recesses for the connecting terminals, for example 2 and 2' separated by a wall 19 and each coupled to the common transverse channel 6 by a respective passageway 13 or 13'.

This embodiment has been selected to illustrate a switch in which each circuit is controlled by a double breaker.

Under these conditions, each upper recess 2, 2' receives a fixed contact such as 42 with a connecting member 44, the common transverse channel 6 serves as a breaking chamber to receive the two fixed contact elements 47 of each fixed contact and a moving bridging contact, and the lower recess 10 receives a common operating member 41 to effect the simultaneous operation of all of the moving contacts.

Figure 9:
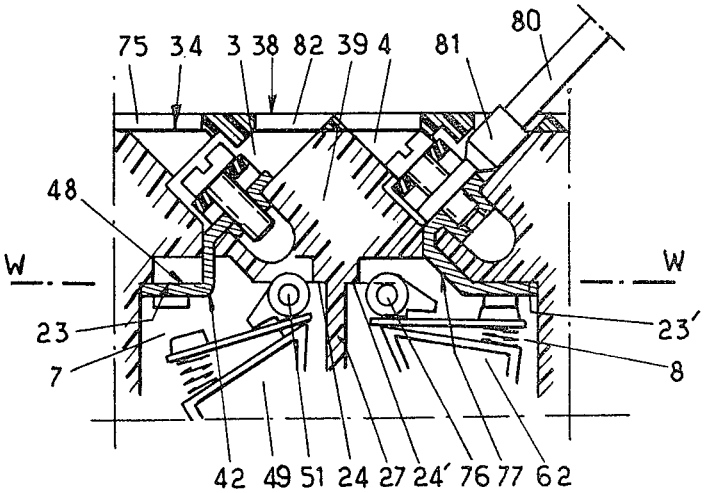
FIG. 9 is an enlarged view of the transverse channels and the upper recesses.

For greater simplicity, only a single side of the complete switch has been shown in FIGS. 1 and 9. The parts of FIG. 1 which have not been sectioned disclose a cover 38 which is placed on the first upper portion 39*a* of the body, itself integral with the wider base portion 40. The upper portions 39*a*–39*b* and the base portion 40 are joined by isolating walls 25–29 produced in a single piece during the moulding of the body 1.

Referring to FIGS. 1 and 9, there is shown a fixed contact 42 the upper threaded extremity 43 of which can receive a connecting member 44 which is placed in the upper recess 3; the central portion 45 of this contact crosses the passageway 14 whilst the lower extremity 46 carrying the contact element 47 is disposed in the transverse channel 7.

By reason of the shape of this fixed contact, the contour of which is obtained by bending of a strip of metal, the placing of it in position in the inverse direction G of FIG. 3 is much facilitated.

Furthermore, this fixed contact, for example the contact 42 visible in FIG. 9 has a pressure face 48 which cooperates with the bearing surface 23 placed in the transverse channel, seen also in FIG. 1. The engagement of these two surfaces is obtained by the placing in position of the cover, as will be explained hereinbelow.

In the example illustrated in FIG. 1, the moving contact 49 is constituted by an insulating contact carrier 50, in the shape of a set-square, which can pivot about the pivot 51 the axis of which is perpendicular to the direction F of displacement of the operating member 41.

Figure 5:
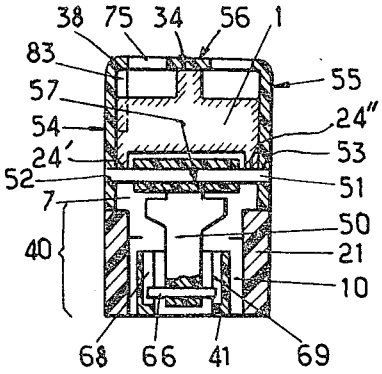
FIG. 5 is a transverse section taken on the line U of the mounted apparatus, visible in FIG. 1.

This pivot, as can be seen in FIG. 5, crosses both the cylindrical openings 52, 53 of the two lateral cheeks 54, 55 of the cover which are perpendicular to the top portion 56, and a bore 57 of the contact carrier 50.

The position of these openings with respect to the body is such that when the cover is placed in position on 39*a* the introduction of the pivot causes the engagement of this latter against a portion of the surface 24 comparable to the surface 23 but placed to the right of the passageway visible in FIG. 2, this portion being constructed in alignment with the bearing surface 23 mentioned hereinabove in order to constitute a plane W of reference.

At the same time, the placing in position of the pivot ensures interdependence between the cover 38 and the body 1 either by engagement of the edge 58 of the cover on the base portion 40, or by engagement of the top portion 56 of the cover on the upper surface 34 of the body.

The pressure face 48 of the fixed contact 42 is itself applied against the surface 23, by means of a notch or boss 83 placed at the interior of the cover and acting on the upper extremity 43 of this contact.

This cover thus fulfills simultaneously the following functions:

(i) during its placing in position (see FIG. 5), it closes off the lateral regions 58, 59, 35, 36 and 60, 61 of the upper recesses, of the transverse channels, and of the passageways, and (ii) it serves to abut together the pivots 51 of the moving contacts, and the surfaces 48 of the fixed contacts on the same plane W of reference, the placing in position of the pivots assuring interdependence between the body and the cover.

Figure 8:
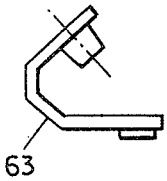

The moving contact carrier which has just been described (in the position 1 of FIG. 6) is assembled so as to have an circuit which is open when at rest. By a simple rotation of the moving contact carrier (position II) visible at 62 in FIG. 1, there is obtained instead a circuit which is closed when at rest, provided that the preceding fixed contact is replaced by a fixed contact such as that having the form denoted by reference 63 in FIG. 8. The construction of this fixed contact again permits it to be placed in position in an extremely simple manner.

In this latter case, the pivot is mounted in a cylindrical opening of the cover, placed differently from the preceding case, but the placing in position of this pivot again causes the same effects as precedingly by inversion of the role of the positioning surfaces which are consequently indicated by references 23', 24' on FIG. 9.

In the embodiment illustrated, the axes of the lateral openings of the cover which are not occupied by a pivot pass substantially through the zone of engagement of the fixed and moving contact elements.

Figure 6:
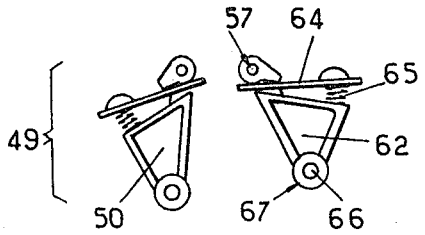
FIG. 6 illustrates two methods of use of the moving contact carrier.
Figure 7:
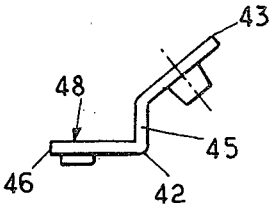
FIGS. 7 and 8 show respectively the types of fixed contact used with the moving contact carriers.

The moving bridging contact 64, see FIG. 6, is associated with the moving contact carrier by means of a pressure spring 65, and the oscillating movement is obtained with the aid of a pin 66 placed at the lower extremity 67 of the contact carrier and engaged in two grooves 68, 69 of the operating member 41 visible in FIG. 1 and in FIG. 5.

The position of these grooves in the operating member is determined in order that the pin of the contact carrier shall be able to engage therein, no matter which position I or II of the contact carrier is selected, to suit the method of switching desired for the circuit with which it is associated.

This operating member 41 is moreover guided and supported in the guiding space 10 by any appropriate means such as a pin 70, integral with the base portion 40 of the body 1 and passing across an oblong opening 71 of the said member, associated with a slideway 72 in order to assure mobility in the direction F.

At one of the extremities 73 of the operating member, a simple coupling means, for example two notches such as 74 permit transfer of movement thereto from any manually or electro-magnetically controlled apparatus.

The combination of the different make or break contacts can be directly observed by the presence or absence of the pins 51 as is indicated at 84 and 85 on FIG. 1.

We claim:

1. A multipolar switch comprising:

a—an elongated insulating body having upper and lower faces and first and second side faces, the said first and second side faces being parallel to the longitudinal direction of said insulating body; the said insulating body having a lower recessed portion opening into the said lower face; the said insulating body further having an intermediate portion, a plurality of partitions in said intermediate portion defining a plurality of transverse channels opening along the first and second side faces and communicating with said recessed portion, each channel having first and second bearing surfaces located in the same plane which is substantially parallel to the said upper and lower faces, the said insulating body further having an upper portion, with a longitudinal insulating partition in said upper portion, said longitudinal partition being parallel to said first and second side faces and substantially equidistant therefrom; said upper portion having, above each of said channels, a pair of recesses opening along the said upper face and along the respective first and second side faces, the two recesses of each pair being separated by the said insulating partition and opening into the respective channel;

b—a plurality of pairs of connecting means, each connecting means comprising a terminal housed in the respective recess of said upper portion, a fixed contact housed in the respective channel and a conductive coupling member connecting the said terminal to the said fixed contact, said fixed contact having a pressure surface which engages a respective first bearing surface of the channel;

c—a plurality of moving contact carriers respectively housed in said channels, each of said contact carriers comprising a contact bridge mounted for engagement with the fixed contacts of the respective pair, said contact carrier further having coupling means;

d—an elongated operating member housing in the lower recessed portion and having a plurality of coupling surface portions in engagement with the respective coupling means of the said contact carriers, said operating member being movable from a first to a second position along said lower recessed portion in a direction of motion substantially parallel to the said upper and lower faces and to said first and second side faces and e—a cover having a top portion covering the said upper face and two first and second parallel side walls, covering the respective side faces of the said insulating body at least in the upper and intermediate portions thereof, said top portion having a plurality of openings respectively located facing the said terminals, said first and second side walls being respectively provided with first and second pluralities of further openings, each first further opening and a corresponding second further opening having an common axis of symmetry at right angles with and in close proximity to a respective second bearing surface of the channel, each of said moving contact carriers having means for pivotally mounting it about the said common axis of symmetry.

2. A multipolar switch as claimed in claim 1, wherein said means for pivotally mounting each moving contact carrier about the said common axis of symmetry include a bearing integrally mounted with the said moving contact carrier, said bearing having a bore, and a pivot engaging said first and second further openings and passing through said bore.

3. A multipolar switch as claimed in claim 1, wherein the said direction of motion of the operating member is oriented from a first bearing surface to the respective second bearing surface.

4. A multipolar switch as claimed in claim 1, wherein the said direction of motion of the operating member is oriented from a second bearing surface to the respective first bearing surface.

5. A multipolar switch comprising:

a—an elongated insulating body having upper and lower faces and first and second side faces, the said first and second side faces being parallel to the longitudinal direction of said insulating body; the said insulating body having a lower recessed portion opening into the said lower face; the said insulating body further having an intermediate portion, a plurality of portions in said intermediate portion defining a plurality of transverse channels opening along the first and second side faces and communicating with said recessed portion, each channel having first and second bearing surfaces located in the same plane which is substantially parallel to the said upper and lower faces, the said insulating body further having an upper portion, with a longitudinal insulating partition in said upper portion, said longitudinal partition being parallel to said first and second side faces and substantially equidistant therefrom; said upper portion having, above each of said channels, a pair of recesses opening along the said upper face and along the respective first and second side faces, the two recesses of each pair being separated by the said insulating partition and opening into the respective channel;

b—first and second pluralities of pairs of connecting means, each connecting means comprising a terminal housed in the respective recess of said upper portion, a fixed contact housed in the respective channel and a conductive coupling member connecting the said terminal to the said fixed contact, the fixed contacts of the first plurality of pairs of connecting means having pressure surfaces which engage respective first bearing surfaces of the channels and the fixed contacts of the second plurality of pairs of connecting means having pressure surfaces which engage respective second bearing surfaces of the channels;

c—first and second pluralities of moving contact carriers respectively housed in said channels, each of said contact carriers comprising a contact bridge mounted for engagement with the fixed contacts of the respective pair of the respective pluralities of pairs of connecting means, said contact carrier further having coupling means;

d—an elongated operating member housed in the lower recessed portion and having a plurality of coupling surface portions in engagement with the respective coupling means of the said contact carriers, said operating member being movable from a first to a second position along said lower recessed portion in a direction of motion substantially parallel to the said upper and lower faces and to said first and second side faces; and e—a cover having a top portion covering the said upper face and two first and second parallel side walls covering the respective side faces of the said insulating body at least in the upper and intermediate portions thereof, said top portion having a plurality of openings respectively located facing the said terminals, said first and second side walls being respectively provided with first and second pluralities of further openings, each first further opening and a corresponding second further opening having a common axis of symmetry at right angles with and in close proximity to a respective second bearing surface of the channel, each of said moving contact carriers of the first plurality having means for pivotally mounting it about the said common axis of symmetry, said first and second side walls further being respectively provided with third and fourth pluralities of further openings, each third further opening and a corresponding fourth further opening having a further common axis of symmetry at right angles with and in close proximity to a respective first bearing surface of the channel, each of said contact carriers of the second plurality having means for pivotally mounting it about the said further common axis of symmetry.

* * * * *